United States Patent [19]

Allocca et al.

[11] Patent Number: 4,963,090

[45] Date of Patent: Oct. 16, 1990

[54] REVERSE FLOW FURNACE/RETORT SYSTEM

[75] Inventors: Clare M. Allocca, Lake Park; Thomas L. Cumella, Jupiter, both of Fla.

[73] Assignee: United Technologies Corporation, Hartford, Conn.

[21] Appl. No.: 431,414

[22] Filed: Nov. 3, 1989

[51] Int. Cl.[5] ..... F27D 7/02; F27D 7/06

[52] U.S. Cl. ..... 432/23; 432/198; 432/200; 432/205; 432/26; 266/255

[58] Field of Search ..... 432/23, 24, 25, 26, 432/47, 198, 200, 205, 208, 242; 266/251, 255, 256

[56] References Cited

U.S. PATENT DOCUMENTS

| | | | |
|---|---|---|---|
| 2,714,760 | 8/1955 | Boam et al. | 29/196 |
| 2,791,415 | 5/1957 | Huppert | 432/205 |
| 3,068,824 | 12/1962 | Stalkev | 266/255 X |
| 3,174,883 | 3/1965 | Hazen et al. | 266/255 X |
| 3,229,967 | 1/1966 | Engelhard | 266/255 |
| 3,301,541 | 1/1967 | Ipsen | 432/205 X |
| 3,565,410 | 2/1971 | Scherff | 432/205 |
| 4,162,141 | 7/1979 | West | 432/200 X |
| 4,241,104 | 12/1980 | Torbet | 427/113 |
| 4,293,338 | 10/1981 | Rose et al. | 75/253 |
| 4,310,302 | 1/1982 | Thekdi et al. | 432/205 |
| 4,504,957 | 3/1985 | McClelland et al. | 373/130 |
| 4,543,059 | 9/1985 | Whang et al. | 432/11 |
| 4,701,127 | 10/1987 | Dockus et al. | 432/198 X |

*Primary Examiner*—Henry A. Bennet
*Assistant Examiner*—Christopher B. Kilner
*Attorney, Agent, or Firm*—Charles E. Sohl

[57] ABSTRACT

Reversing the flow of conventional furnace/retort systems prevents damaging exhaust gases from entering the furnace while still maintaining a gas flow through the retort. The gases exit the retort into a treatment system; preventing contamination of any apparatus and the escape of any hazardous gases.

6 Claims, 1 Drawing Sheet

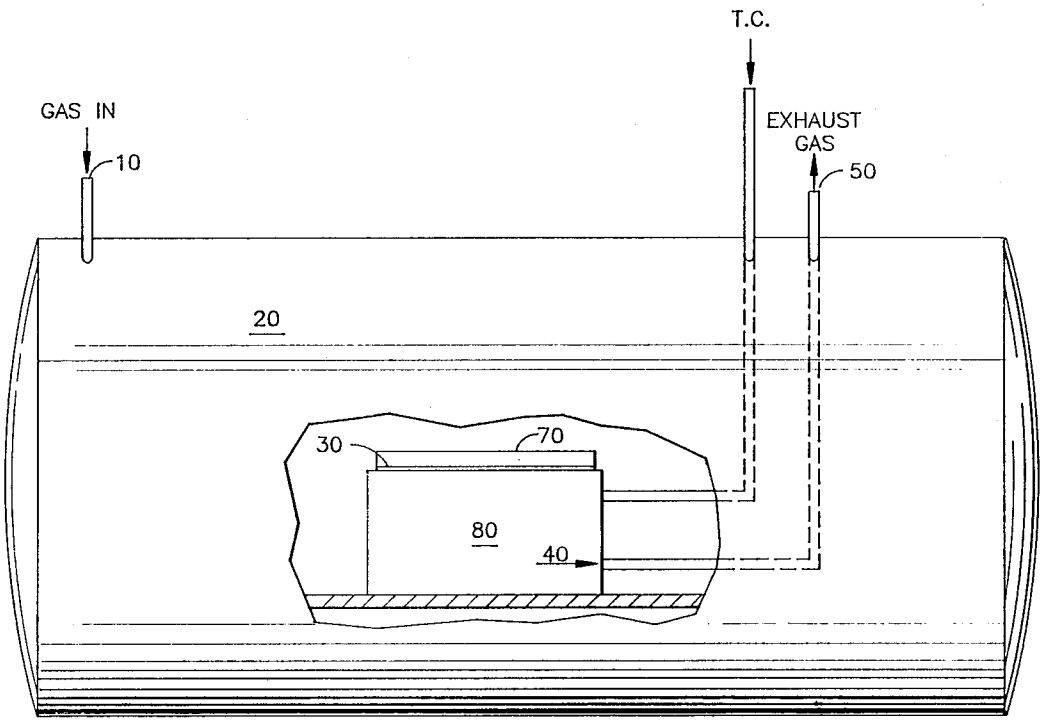
GAS IN
10
20
30
70
80
40
T.C.
EXHAUST GAS
50

REVERSE FLOW FURNACE/RETORT SYSTEM

TECHNICAL FIELD

This invention relates to a furnace/retort system with a modified gas flow path, and especially to reversing the conventionally used gas flow path within a furnace/-retort system to prevent furnace contamination.

BACKGROUND ART

A retort is often utilized to provide a controlled atmosphere during heat treating. The retort used within a furnace has a gas inlet and outlet. Gas leakage can be eliminated by sealing the retort with a lid. In this system, retort exhaust never comes in contact with the furnace; the gas outlet port is connected to a ventilation source. However, limitations arise due to the difficulty in securing and removing the lid.

A sand sealed retort, commonly known in the art, employs the basic design of the sealed lid retort, with sand used to seal the lid which is either clamped on or held on by its own weight; allowing easy lid removal. The gas enters the retort through an inlet port and exits through the sand seal, due to a pressure gradient which also prevents furnace atmosphere infiltration into the retort. This process allows the exhaust gas to contact the inner surface of the furnace; an acceptable occurrence only if either the gases are inert, or furnace damage is acceptable.

Retort systems which employ a sand seal are used for bonding carbon substrates, diffusion coating, and annealing. (U.S. Pat. Nos. 4,241,104, 4,293,338, 4,310,302, and 4,504,957, incorporated herein by reference).

A similar technique for maintaining the desired retort environment is disclosed in U.S. Pat. No. 4,701,127 (incorporated herein by reference). A deformable metallic foil gasket which is sufficiently porous to permit outflow of purging gas is utilized instead of a sand seal.

Although the use of a sand seal or deformable metallic foil gasket allows for easy lid removal, there are inherent disadvantages. Furnaces can seldom be completely sealed from leakage into the atmosphere. Since the gases flow from the retort into the furnace, the escape of hazardous gases into the atmosphere becomes a real problem. Furthermore, even if the gases are not "hazardous", they still may contaminate or damage the furnace itself, adding the cost of cleaning or replacing the furnace. Improved techniques which impede the escape of gases and prevent the contamination or damage of the furnace, while still allowing for easy lid removal, are sought.

DISCLOSURE OF INVENTION

The present invention relates to a reverse flow furnace/retort system; flow direction is opposite conventional systems. A pressure gradient maintained across a porous seal inducing the gas to flow from the furnace into the retort. Such a system maintains a uniform flow through the retort while preventing the possibility of escaping gaseous reaction products from the furnace. The reaction products move directly from the system into a treatment system; eliminating furnace exposure. The present invention has particular utility with clean or non-deleterious input reactant gases and dirty or otherwise deleterious exhaust gases.

The foregoing and other features and advantages of the present invention will become more apparent from the following description and accompanying drawing.

BRIEF DESCRIPTION OF DRAWING

The FIGURE is a possible embodiment of the present invention.

BEST MODE FOR CARRYING OUT THE INVENTION

Sealed heat treatment systems which require a constant flow of gas to maintain an inert atmosphere, often utilize a pressure gradient retort sand seal system with the gases flowing from the retort into a furnace. A reverse flow, from the furnace to the retort, eliminates various problems such as furnace contamination and damage; while permitting better control of the exiting gases.

Furnaces, due to their size, often are not completely air tight and leakage to the atmosphere may occur. Therefore, the present invention is especially useful in applications where the output gas is either dirty, hazardous, or otherwise deleterious. The exhaust gas passes directly to a treatment system; preventing possible furnace contamination or leakage.

The FIGURE, a possible embodiment of the present invention, shows the flow of the gas. The gas enters the gas tight furnace (20) at port (10), pressurizing the furnace chamber (for example, a so called vacuum furnace) and creating a pressure gradient across the sand seal (30). The pressure gradient causes the gas to flow through the seal (30) into the retort (80). The exhaust gas exits the retort (80) through tube (B) at point (40), and the system at port (50), which is commonly connected to a bubbler and a hood or equivalent flow control and hazardous waste treatment system.

EXAMPLE

The following procedure describes the set up for the reverse flow sand seal retort system. This procedure can be utilized to heat treat any material which requires a controlled atmosphere during heating.

1. The material to be heat treated is placed within the retort (80; see the Figure).
2. Sand (aluminum oxide ($A1_2O_3$ grit) is used to fill the seal area (30).
3. The lid (70) is placed against the sand seal (30).
4. The retort (80) is placed within a vacuum furnace (20).
5. A thermocouple is fed into the retort (80) through port (60) (tube (A)) which is sealed with a ceramic adhesive (High Temperature Ceramic Adhesive #571, produced by Aremco Products Inc., P.0. Box 529, Ossining, NY 10562-0429), and attached on the other end to digital temperature readout and/or controller.
6. Exhaust tubing (B) (also sealed with a ceramic adhesive) is fed into the retort (80), and connected on the other end to a bubbler. Note, the gas flow to the bubbler is monitored to maintain a positive pressure of about 1 psi to about 3 psi.
7. A vacuum is pulled on the furnace (20), and the furnace (20) is then backfilled with nitrogen. The excess gas within the system travels through the sand seal (30) into the retort (80) and out exhaust tube (B). Note, exhaust tube (B) is connected to a gas treatment system, the type o system being dependent on the type of gases produced within the retort.

8. The desired heat treatment cycle (dependent on the type of material utilized) is run.

Although this invention has been shown and described with respect to detailed embodiments thereof, it will be understood by those skilled in the art that various changes in form and detail thereof may be made without departing from the spirit and scope of the claimed invention.

We claim:

1. A method for preventing contamination of a furnace, said method using a gas tight furnace and a retort, which comprises:

a. placing the retort in the furnace;

b. using a porous seal to create a controlled leakage path between the furnace and retort;

c. creating a pressure gradient between the retort and the furnace; and d. removing the exhaust gas from the retort; whereby a pressure gradient is created across the porous seal such that the pressure within the retort is greater than the pressure on the other side of the porous seal, wherein the pressure gradient causes the gas to flow into the retort.

2. A method as in claim 1 wherein said controlled leakage path is crated with a porous seal, said porous seal is selected for the group consisting of a sand seal and a deformable metallic foil gasket.

3. A controlled atmosphere system, which comprises:

a. means for heating which is gas tight;

b. sealable vessel which can be placed within said heating means;

c. means for introducing gas into the heating means;

d. means for creating a leakage path between said vessel and said heating means;

e. means for producing a pressure gradient between said heating means and said sealable vessel to produce a flow of gas from said heating means into said sealable vessel;

f. means for exhausting gas from said sealable vessel to the ambient atmosphere;

whereby gas flows into through said heating means, enters the sealable vessel, following said leakage path, and exits the system through the gas exhaust means, and wherein the gas flow is induced via a pressure gradient.

4. A system as in claim 3 wherein said leakage path is created with a porous seal, said porous seal is selected from the group consisting of a sand seal and a deformable metallic foil gasket.

5. A system as in claim 3 wherein said heating means is a type of furnace.

6. A system as in claim 3 wherein said sealable vessel is a retort.

* * * * *